US011898410B2

(12) United States Patent
Al-Baiyat

(10) Patent No.: US 11,898,410 B2
(45) Date of Patent: Feb. 13, 2024

(54) METHOD AND SYSTEM FOR PREDICTING LOCATIONS OF STUCK PIPE EVENTS

(71) Applicant: SAUDI ARABIAN OIL COMPANY, Dhahran (SA)

(72) Inventor: Islam Ali Al-Baiyat, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 210 days.

(21) Appl. No.: 17/469,478

(22) Filed: Sep. 8, 2021

(65) Prior Publication Data

US 2023/0070218 A1 Mar. 9, 2023

(51) Int. Cl.

| | |
|---|---|
| ***E21B 31/03*** | (2006.01) |
| ***E21B 47/09*** | (2012.01) |
| ***E21B 21/08*** | (2006.01) |

(52) U.S. Cl.

CPC ..... *E21B 31/03* (2013.01); *E21B 21/08* (2013.01); *E21B 47/09* (2013.01); *E21B 2200/20* (2020.05); *E21B 2200/22* (2020.05)

(58) Field of Classification Search

CPC ..... E21B 31/03; E21B 21/08; E21B 47/09; E21B 2200/20; E21B 2200/22; E21B 44/00

See application file for complete search history.

(56) References Cited

U.S. PATENT DOCUMENTS

| | | | | |
|---|---|---|---|---|
| 4,966,234 | A | 10/1990 | Whitten | |
| 6,820,702 | B2 | 11/2004 | Niedermayr et al. | |
| 8,284,074 | B2 | 10/2012 | Orban et al. | |
| 8,752,648 | B2 | 6/2014 | Goebel et al. | |
| 9,970,266 | B2 | 5/2018 | Marx et al. | |
| 10,513,920 | B2 | 12/2019 | Salminen et al. | |
| 10,597,995 | B2 | 3/2020 | Priyadarshy | |
| 10,830,033 | B2 | 11/2020 | Weideman et al. | |
| 2005/0240351 | A1* | 10/2005 | Gray | E21B 47/09 702/6 |
| 2015/0300151 | A1 | 10/2015 | Mohaghegh | |
| 2018/0171774 | A1 | 6/2018 | Ringer et al. | |
| 2020/0173268 | A1* | 6/2020 | Zhang, Jr. | G05B 13/04 |

(Continued)

FOREIGN PATENT DOCUMENTS

| | | |
|---|---|---|
| AU | 621138 B2 | 3/1992 |
| CN | 204140059 U | 2/2015 |

*Primary Examiner* — Kristyn A Hall

(74) *Attorney, Agent, or Firm* — Osha Bergman Watanabe & Burton LLP

(57) ABSTRACT

A method may include determining a stuck pipe event in a well operation for a well. The method may further include obtaining well data regarding the well operation and stuck pipe data regarding the stuck pipe event. The method may further include determining, using the well data and the stuck pipe data, a diagnostic action for the stuck pipe event. The method may further include transmitting a command to a stuck pipe adapter to perform the diagnostic action. The stuck pipe adapter may be a substitute adapter for a drill string or a work string in the well. The method may further include obtaining diagnostic data regarding the stuck pipe event in response to the stuck pipe adapter performing the diagnostic action. The method may further include determining a predicted location in the well of the stuck pipe event based on the diagnostic data and a machine-learning algorithm.

19 Claims, 5 Drawing Sheets

(56) References Cited

U.S. PATENT DOCUMENTS

| | | | |
|---|---|---|---|
| 2020/0224525 | A1 | 7/2020 | Parmeshwar et al. |
| 2020/0232311 | A1 | 7/2020 | Hamzah |
| 2020/0284145 | A1 | 9/2020 | ElGamal |
| 2020/0355839 | A1 | 11/2020 | Jeong et al. |
| 2020/0370409 | A1 | 11/2020 | Yu et al. |
| 2021/0017847 | A1 | 1/2021 | Aragall et al. |

* cited by examiner

METHOD AND SYSTEM FOR PREDICTING LOCATIONS OF STUCK PIPE EVENTS

BACKGROUND

Stuck pipe situations may occur where movement and/or rotation of a drill string becomes frozen or restricted. This situation may range from a minor inconvenience to a major complication at a well. A severe stuck pipe case may result in the loss of a drill string or a complete loss of a well. Stuck pipe situations may be caused by various well parameters, such as differential pressure, inappropriate drilling fluid for a particular operation, various drilling properties, and poor wellbore cleaning.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes determining, by a computer processor, a stuck pipe event in a well operation for a well. The method further includes obtaining, by the computer processor, well data regarding the well operation and stuck pipe data regarding the stuck pipe event. The method further includes determining, by the computer processor and using the well data and the stuck pipe data, a diagnostic action for the stuck pipe event. The method further includes transmitting, by the computer processor, a command to a stuck pipe adapter to perform the diagnostic action. The stuck pipe adapter is a substitute adapter for a drill string or a work string in the well. The method further includes obtaining, by the computer processor, diagnostic data regarding the stuck pipe event in response to the stuck pipe adapter performing the diagnostic action. The method further includes determining, by the computer processor, a predicted location in the well of the stuck pipe event based on the diagnostic data and a machine-learning algorithm.

In general, in one aspect, embodiments relate to an apparatus that includes a computer processor, a communication interface, various sensors, and a diagnostic assembly coupled to the sensors and the computer processor. The diagnostic assembly applies a predetermined amount of tension in a drill string or a work string. The apparatus further includes a memory coupled to the computer processor. The memory includes instructions that obtain, over a network connection, a command to perform a diagnostic action to the drill string or the work string. The memory further includes instructions that generate, using the sensors and the diagnostic assembly, diagnostic data based on performing the diagnostic action. The memory further includes instructions that transmit, over the network connection, the diagnostic data.

In general, in one aspect, embodiments relate to a system that includes a drilling rig and a drill string coupled to the drilling rig. The drill string includes various pipe sections. The system further includes a stuck pipe adapter coupled to the drill string. The stuck pipe adapter includes a first computer processor and a communication interface. The stuck pipe adapter produces a predetermined amount of tension in at least one pipe section among the pipe sections. The system further includes a stuck pipe manager coupled to the stuck pipe adapter. The stuck pipe manager includes a second computer processor. The stuck pipe manager obtains well data regarding a drilling operation and stuck pipe data regarding a stuck pipe event associated with the drill string. The stuck pipe manager further determines, using the well data and the stuck pipe data, a diagnostic action for the stuck pipe event. The stuck pipe manager transmits a command to the stuck pipe adapter that causes the stuck pipe adapter to perform the diagnostic action. The stuck pipe manager further obtains diagnostic data regarding the stuck pipe event in response to the stuck pipe adapter performing the diagnostic action. The stuck pipe manager further determines a predicted location in the well of the stuck pipe event based on the diagnostic data and a machine-learning algorithm.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for determining information regarding a stuck pipe event. A stuck pipe event may be a situation during a well operation where a drill string or work string becomes immovable or restricted within a wellbore. Thus, some embodiments use various machine-learning techniques and a stuck pipe adapter attached to determine information regarding the stuck pipe event. By knowing the type and depth of a stuck pipe event, for example, an appropriate remediation procedure may be implemented to free a drill string or work string.

Furthermore, a stuck pipe adapter may be an apparatus that can be coupled to the drill string or work string around the surface (e.g., in a similar fashion as a substitute adapter, such as a head sub or a shock sub) to perform different types of diagnostic actions on the stuck pipe event. The stuck pipe adapter may be coupled to a stuck pipe manager to communicate diagnostic data and receive commands, e.g., over a wireless network connection in a well network. This network communication may allow an interactive analysis of the stuck pipe event using diagnostic data, well data, and/or stuck pipe data. Consequently, this data may be used with one or more machine-learning techniques to predict the location of the stuck pipe event within a wellbore. In some embodiments, for example, an artificial neural network may use diagnostic data and other data types as input features to determine predicted locations of one or more stuck pipe events as the output. While some embodiments determine stuck pipe events for drilling operations, other well operations are contemplated such as stuck pipe events in completion operations or well intervention operations.

Figure 1:
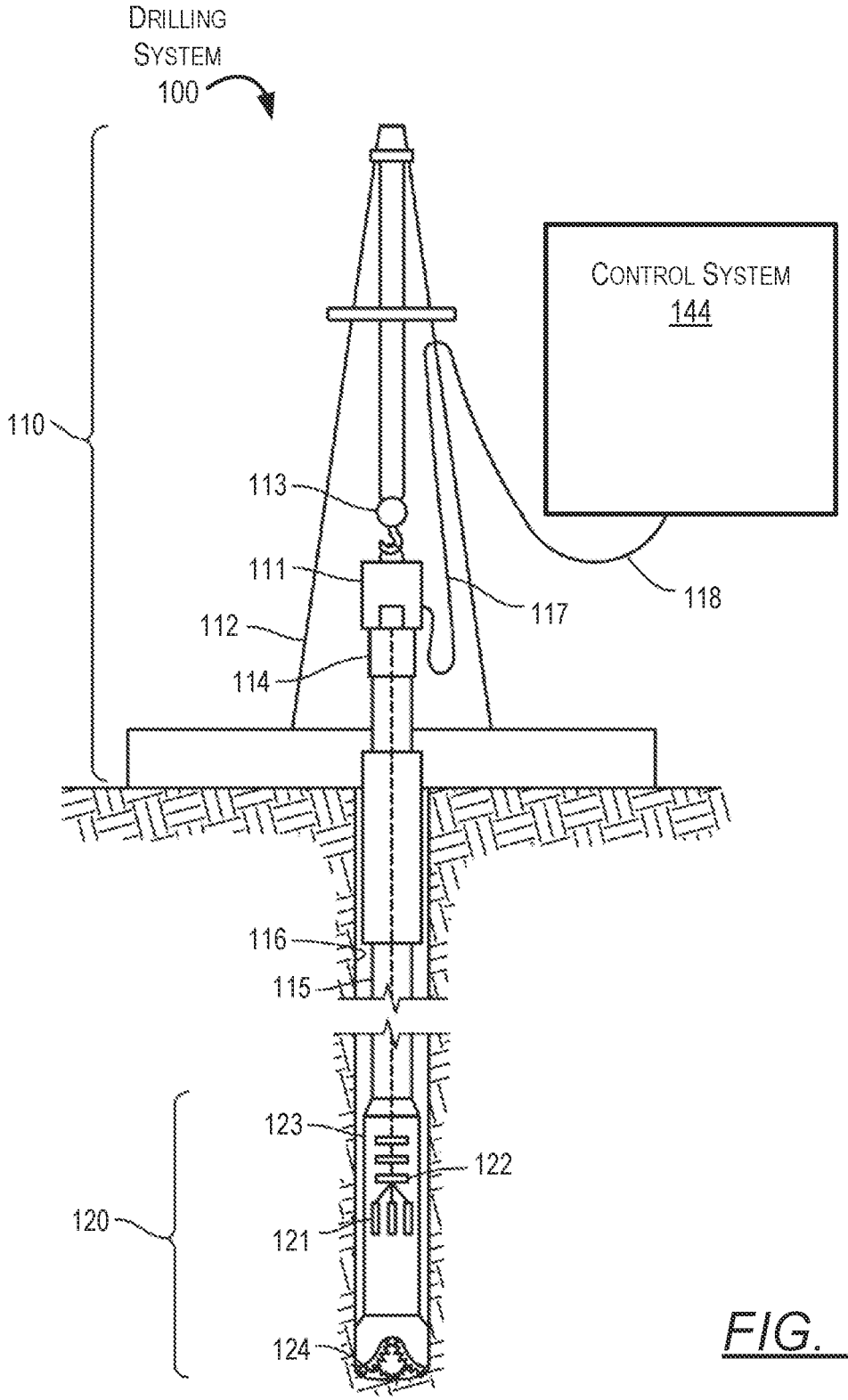
FIGS. 1, 2, and 3 show systems in accordance with one or more embodiments.

Turning to FIG. 1, FIG. 1 shows a drilling system (100) that may include a top drive drilling rig (110) arranged around the setup of a drill bit logging tool (120). A top drive drilling rig (110) may include a top drive (111) that may be suspended in a derrick (112) by a travelling block (113). In the center of the top drive (111), a drive shaft (114) may be coupled to a top pipe of a drill string (115), for example, by threads. The top drive (111) may rotate the drive shaft (114), so that the drill string (115) and a drill bit logging tool (120) cut the rock at the bottom of a wellbore (116). A power cable (117) supplying electric power to the top drive (111) may be protected inside one or more service loops (118) coupled to a control system (144). As such, drilling mud may be pumped into the wellbore (116) through a mud line, the drive shaft (114), and/or the drill string (115).

The control system (144) may include one or more programmable logic controllers (PLCs) that include hardware and/or software with functionality to control one or more processes performed by the drilling system (100). Specifically, a programmable logic controller may control valve states, fluid levels, pipe pressures, warning alarms, and/or pressure releases throughout a drilling rig. In particular, a programmable logic controller may be a ruggedized computer system with functionality to withstand vibrations, extreme temperatures, wet conditions, and/or dusty conditions, for example, around a drilling rig. For example, the control system (144) may be coupled to the sensor assembly (123) in order to perform various program functions for up-down steering and left-right steering of the drill bit (124) through the wellbore (116). While one control system is shown in FIG. 1, the drilling system (100) may include multiple control systems for managing various well drilling operations, maintenance operations, well completion operations, and/or well intervention operations.

The wellbore (116) may include a bored hole that extends from the surface into a target zone of the hydrocarbon-bearing formation, such as the reservoir. An upper end of the wellbore (116), terminating at or near the surface, may be referred to as the "up-hole" end of the wellbore (116), and a lower end of the wellbore, terminating in the hydrocarbon-bearing formation, may be referred to as the "downhole" end of the wellbore (116). The wellbore (116) may facilitate the circulation of drilling fluids during well drilling operations, the flow of hydrocarbon production ("production") (e.g., oil and gas) from the reservoir to the surface during production operations, the injection of substances (e.g., water) into the hydrocarbon-bearing formation or the reservoir during injection operations, or the communication of monitoring devices (e.g., logging tools) into the hydrocarbon-bearing formation or the reservoir during monitoring operations (e.g., during in situ logging operations).

As further shown in FIG. 1, sensors (121) may be included in a sensor assembly (123), which is positioned adjacent to a drill bit (124) and coupled to the drill string (115). Sensors (121) may also be coupled to a processor assembly (123) that includes a processor, memory, and an analog-to-digital converter (122) for processing sensor measurements. For example, the sensors (121) may include acoustic sensors, such as accelerometers, measurement microphones, contact microphones, and hydrophones. Likewise, the sensors (121) may include other types of sensors, such as transmitters and receivers to measure resistivity, gamma ray detectors, etc. The sensors (121) may include hardware and/or software for generating different types of well logs (such as acoustic logs or sonic longs) that may provide well data about a wellbore, including porosity of wellbore sections, gas saturation, bed boundaries in a geologic formation, fractures in the wellbore or completion cement, and many other pieces of information about a formation. If such well data is acquired during well drilling operations (i.e., logging-while-drilling), then the information may be used to make adjustments to drilling operations in real-time. Such adjustments may include rate of penetration (ROP), drilling direction, altering mud weight, and many others drilling parameters.

In some embodiments, acoustic sensors may be installed in a drilling fluid circulation system of a drilling system (100) to record acoustic drilling signals in real-time. Drilling acoustic signals may transmit through the drilling fluid to be recorded by the acoustic sensors located in the drilling fluid circulation system. The recorded drilling acoustic signals may be processed and analyzed to determine well data, such as lithological and petrophysical properties of the rock formation. This well data may be used in various applications, such as steering a drill bit using geosteering, casing shoe positioning, etc.

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic and acid stimulation of a reservoir region, and/or installing a production tree or wellhead assembly at the wellbore (116). Likewise, well operations may include open-hole completions or cased-hole completions. For example, an open-hole completion may refer to a well that is drilled to the top of the hydrocarbon reservoir. Thus, the well is cased at the top of the reservoir, and left open at the bottom of a wellbore. In contrast, cased-hole completions may include running casing into a reservoir region. Cased-hole completions are discussed further below with respect to perforation operations.

In one well operation example, the sides of the wellbore (116) may require support, and thus casing may be inserted into the wellbore (116) to provide such support. After a well has been drilled, casing may ensure that the wellbore (116) does not close in upon itself, while also protecting the wellstream from outside incumbents, like water or sand. Likewise, if the formation is firm, casing may include a solid string of steel pipe that is run on the well and will remain that way during the life of the well. In some embodiments, the casing includes a wire screen liner that blocks loose sand from entering the wellbore (116).

In another well operation example, a space between the casing and the untreated sides of the wellbore (116) may be cemented to hold a casing in place. This well operation may include pumping cement slurry into the wellbore (116) to displace existing drilling fluid and fill in this space between the casing and the untreated sides of the wellbore (116). Cement slurry may include a mixture of various additives and cement. After the cement slurry is left to harden, cement may seal the wellbore (116) from non-hydrocarbons that attempt to enter the wellstream. In some embodiments, the cement slurry is forced through a lower end of the casing and into an annulus between the casing and a wall of the wellbore (116). More specifically, a cementing plug may be used for pushing the cement slurry from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

Keeping with well operations, some embodiments include perforation operations. More specifically, a perforation operation may include perforating casing and cement at different locations in the wellbore (116) to enable hydrocarbons to enter a wellstream from the resulting holes. For example, some perforation operations include using a perforation gun at different reservoir levels to produce holed sections through the casing, cement, and sides of the wellbore (116). Hydrocarbons may then enter the wellstream through these holed sections. In some embodiments, perforation operations are performed using discharging jets or shaped explosive charges to penetrate the casing around the wellbore (116).

In another well operation, a filtration system may be installed in the wellbore (116) in order to prevent sand and other debris from entering the wellstream. For example, a gravel packing operation may be performed using a gravel-packing slurry of appropriately sized pieces of coarse sand or gravel. As such, the gravel-packing slurry may be pumped into the wellbore (116) between a casing's slotted liner and the sides of the wellbore (116). The slotted liner and the gravel pack may filter sand and other debris that might have otherwise entered the wellstream with hydrocarbons.

In some embodiments, well intervention operations may include various operations carried out by one or more service entities for an oil or gas well during its productive life (e.g., fracking operations, CT, flow back, separator, pumping, wellhead and Christmas tree maintenance, slickline, wireline, well maintenance, stimulation, braded line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore (116) prior to delivering the well to a producing entity.

Figure 2:
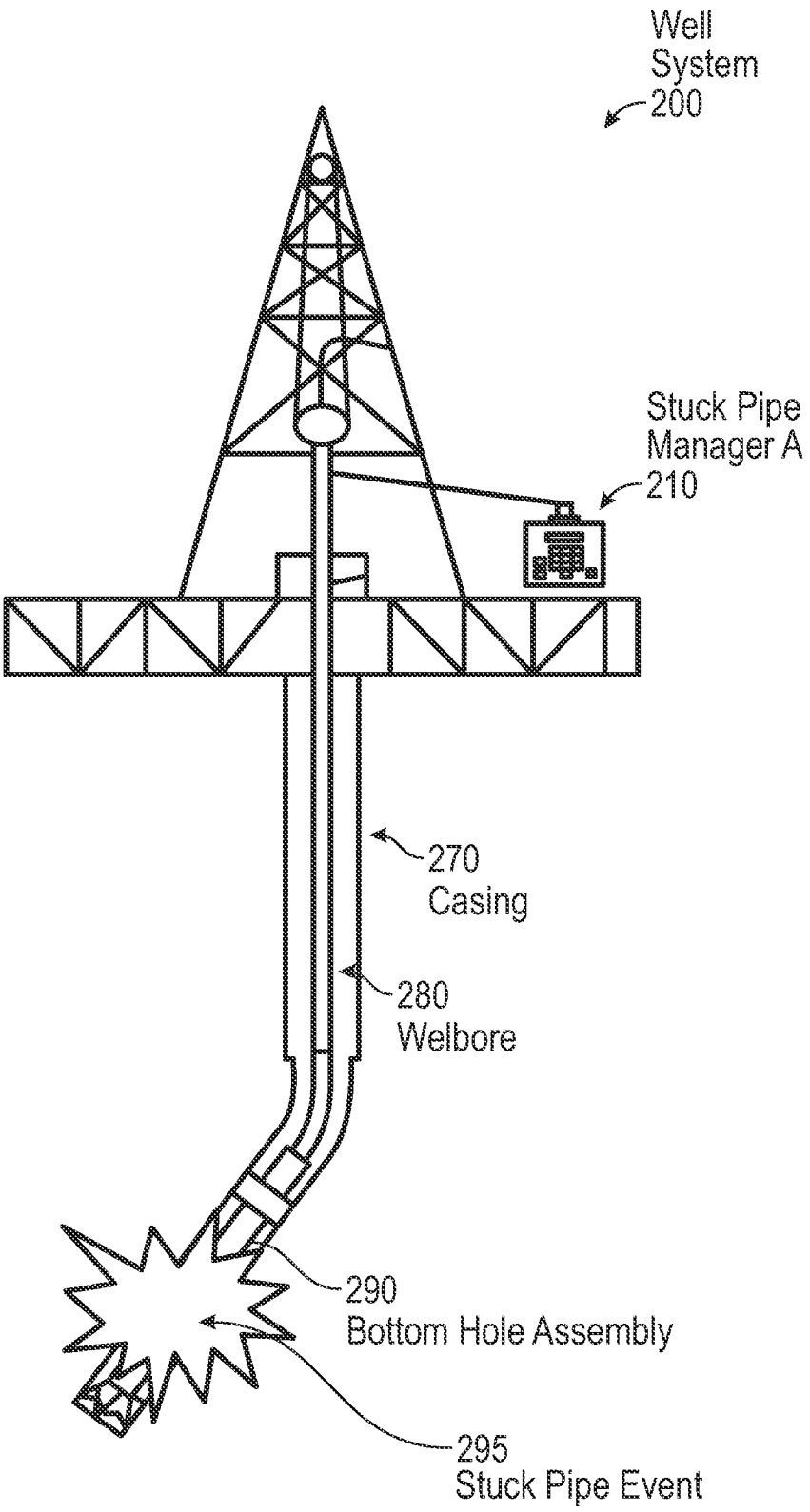

Turning to FIG. 2, FIG. 2 shows a schematic diagram in accordance with one or more embodiments. As shown in FIG. 2, a well system (e.g., well system (200)) may include a wellbore (e.g., wellbore (280)), casing (e.g., casing (270)), and a bottom hole assembly (e.g., bottom hole assembly (290)). Various types of well operations may be performed at a well system, such as drilling operations or completion operations. For example, drilling operations may use a drill string (not shown), while completion operations or well intervention operations may use a work string to perform various tasks. During some well operations, a stuck pipe event (295) may occur inside the wellbore. For example, a drill string or a work string may become stuck inside an open hole due to different reasons. In a drilling operation, a stuck pipe event may be result of one or more hole conditions while drilling, making pipe connections, reaming down, back reaming, or other drilling operation that can result in a downhole string becoming difficult to move. In a completion operation or a well intervention operation, stuck pipe events may also occur. As such, a stuck pipe incident during a well operation may lead to various well complications that may require a sidetrack operation (e.g., drilling a second well path around a primary well path) or abandoning an original mother-bore or open hole.

A stuck pipe event may be caused by well geometry, differential-pressure sticking, and/or mechanical sticking. With well geometry events, a bottomhole assembly for a particular drill string or a work string may not match the shape of a particular well. Therefore, the particular string may be unable to pass through a specific section of the well. With differential-pressure sticking, pressure in an annulus may exceed pressure in a formation and cause a drill string to be embedded in a filter cake (e.g., residue deposited on a permeable medium when a slurry, such as a drilling fluid, is forced against the medium) in a wellbore's wall. Thus, differential pressure may cause pipe sections to be held against the filter cake and a wellbore wall. In directional drilling, various angles and horizontal sections of a well may cause extended contact between the drill string and a formation due to gravity.

With mechanical sticking, stuck pipe events may include keyseating events, packoff events from poor hole-cleaning; shale swelling events, wellbore collapse events, and bridging events. With keyseating events, a small hole or groove may be worn into a side of a wellbore due to a drill string's rotation. Packoff events and bridging events may be the result of unexpected accumulations in a wellbore, such as formation cuttings and other junk that collects around a borehole assembly and block an annulus between the drill string and the wellbore. With shale swelling events, water in drilling fluid may be absorbed by a shale formation that results in a swelling effect on the formation. After swelling to a particular size, shale particles may fall apart and block a drill string. Shale swelling events may occur after several days of water absorption from various well operations.

In some embodiments, a well system includes a stuck pipe manager (e.g., stuck pipe manager A (210)). For example, a stuck pipe manager (160) may be coupled to one or more control systems (e.g., control system (144)) at a wellsite and operate one or more applications for managing stuck pipe events. In particular, a stuck pipe manager (160) may include hardware and/or software to determine a presence of one or more stuck pipe events (e.g., stuck pipe event (295)) and/or determine a predicted location of the one or more stuck pipe events in a well bore. In some embodiments, a stuck pipe manager may be similar to a control system coupled to the drilling system (100). The stuck pipe manager may include one or more pipe stretch models and/or one or more machine-learning algorithms for use with stuck pipe events. In some embodiments, the stuck pipe manager may include a computer system that is similar to the computer system (502) described below with regard to FIG. 5 and the accompanying description. For more information on stuck pipe managers, see FIG. 3 and the accompanying description below.

After detecting a stuck pipe event, one or more remediation procedures may be performed at a well system depending on the event type. For example, if cutting accumulation or hole sloughing caused the stuck pipe event, a drill string may be rotated to increase flow rate to free a particular pipe section. This remediation procedure may be performed without exceeding a predetermined drilling fluid density, such as the maximum allowed equivalent circulating density (ECD). If a wellbore narrows as a result of plastic shale, a remediation procedure may include an increase to drilling fluid weight to dislodge one or more pipe sections. Some remediations procedures include circulating fresh water in a particular region of the wellbore. If a keyseating event occurs, a drill string may be backed off below the keyseating section and an opener may be used in the wellbore to drill out the keyseating section around one or more pipe sections. For a differential-pressure event, remediation procedures may include using a mud-hydrostatic-pressure reduction in the annulus or oil-spotting around the stuck portion of the drill string. Another remediation procedure for a differential-pressure event is washing a wellbore region located around the stuck pipe. In some embodiments, a stuck pipe event requires a sidetrack operation to circumvent a difficult geological region that caused the stuck pipe event.

Figure 3:
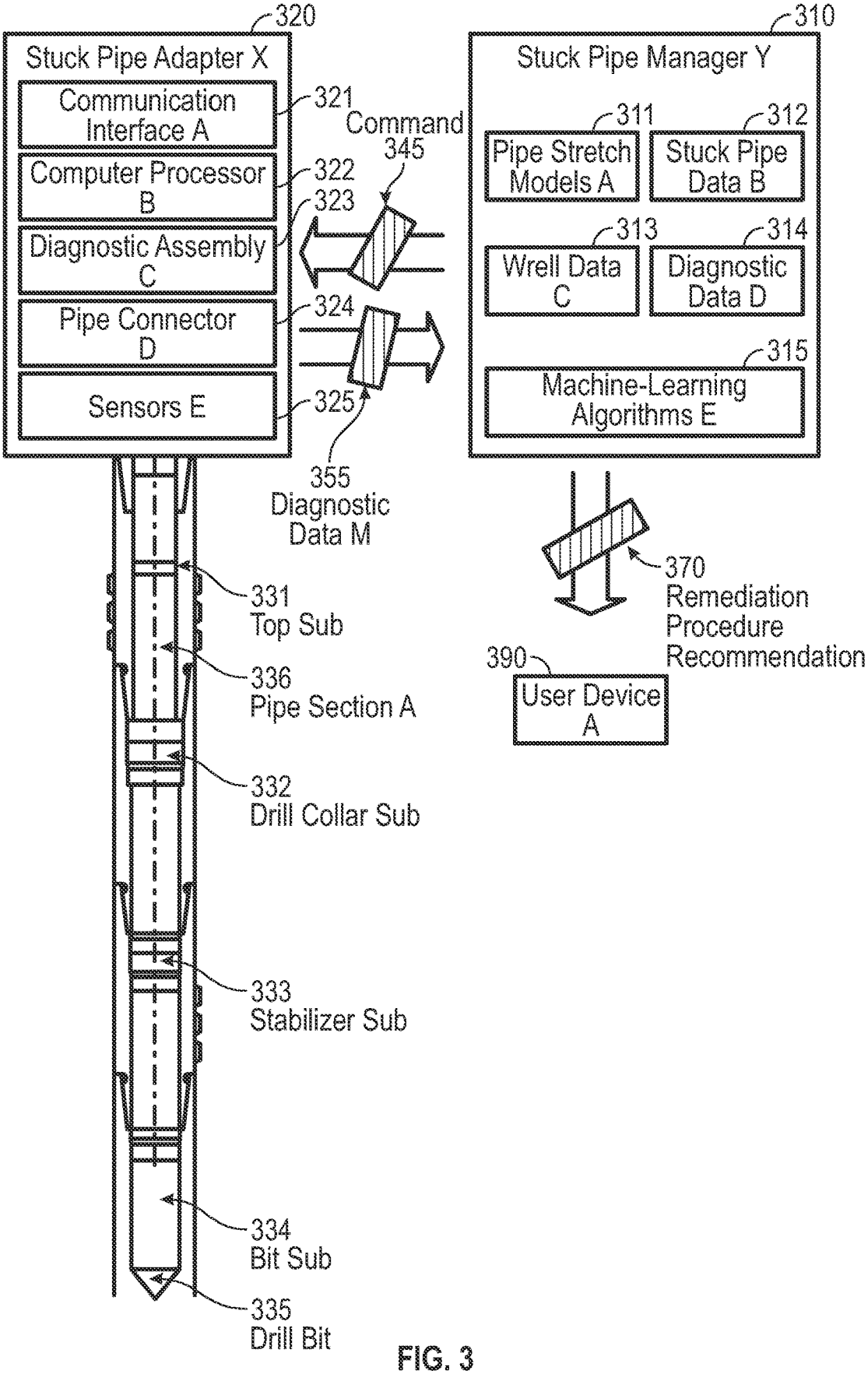

Turning to FIG. 3, FIG. 3 shows a schematic diagram in accordance with one or more embodiments. As shown in FIG. 3, a stuck pipe manager (e.g., stuck pipe manager Y (310)) may be coupled to one or more stuck pipe adapters (e.g., stuck pipe adapter X (320)) and one or more user devices (e.g., user device A (390)). In some embodiments, for example, a stuck pipe adapter may be a substitute adapter (also called a "sub") that is connected on a drill pipe stickup on a well surface. In particular, a stuck pipe adapter may include hardware and/or software, such as a communication interface (e.g., communication interface A (321)), a computer processor (e.g., computer process B (322)), a diagnostic assembly (e.g., diagnostic assembly C (323)), one or more connectors (e.g., pipe connector D (324)), and/or one or more sensors (e.g., sensors E (325)). For example, the stuck pipe adapter may be a substitute adapter that can be disposed on drill pipe or the surface of another tubular during a stuck pipe event in a well. Substitute adapters may include various lengths of pipe, collars, casings, connectors, etc. with one or more predetermined functions for a well operation. In some embodiments, the stuck pipe adapter attaches to another substitute adapter that forms the connection to one or more pipe sections (e.g., pipe section A (336)) within the wellbore.

Moreover, a stuck pipe adapter may include a diagnostic assembly (e.g., diagnostic assembly C (323)) with hardware and/or software with functionality for performing one or more diagnostic actions on a drill string or work string. For example, a diagnostic assembly may include sensors and one or more actuators, such as a hydraulic actuator and/or an electric actuator to generate tension. Hydraulic actuators may include various actuation components, such as pistons, slides, or valves, as well as a pump, pipe sections, valves, and/or storage tanks. Likewise, an electric actuator may include an electric motor, one or more switches, a spindle such as a lead screw, and an internal or external power supply.

Furthermore, a stuck pipe adapter may include functionality to perform diagnostic actions to produce diagnostic data for determining a location of a stuck pipe event. In a diagnostic action, a stuck pipe adapter may apply a predetermined amount of tension on a pipe's surface to diagnose a particular type of stuck pipe event. Thus, diagnostic data may include pipe stretch data that may be used with a pipe stretch model for identifying depth values of one or more stuck points. By comparing previous pipe stretch data to pipe stretch data during a stuck pipe event, a pipe stretch model (e.g., pipe stretch models A (311)) may identify the depth value of stuck points in a vertical or a deviated well.

In some embodiments, a stuck pipe event may be assessed for different remediation procedures (e.g., a particular plan for pipe recovery) by identifying the location of a stuck point. For example, whether a specific stuck point is below a jar or above the jar to determine a particular remediation procedure. As such, diagnostic data may describe different levels and/or types of complications during a stuck pipe incident. Deviated wells may require several parameters and factors especially to accurately diagnose a stuck pipe event.

Returning to a stuck pipe manager, the stuck pipe manager may use different types of data to determine one or more diagnostic actions, such as stuck pipe data (e.g., stuck pipe data B (312)), well data (e.g., well data C (313)), and/or diagnostic data (e.g., diagnostic data D (314)). For example, stuck pipe data may be associated with information relating to the occurrence of stuck pipe event in a well operation, such as the last known depth of the drill bit within a wellbore or drilling data or completion data preceding detection of a stuck pipe event. Well data may describe various well characteristics undergoing a well operation, such as one or more formation types within the well, the type of well (e.g., a vertical well or a horizontal well), reservoir data regarding the well (e.g., is the well in a reservoir that is partially depleted from past production), etc. Diagnostic data may include information relating to one or more pipe stretch tests performed in one or more diagnostic actions by a stuck pipe adapter.

In some embodiments, a stuck pipe manager may use one or more machine-learning algorithms (e.g., machine-learning algorithms E (315)) to predict stuck pipe locations. For example, a machine-learning algorithm may be a training algorithm, such as an unsupervised algorithm, a reinforcement learning algorithm, or a self-supervised algorithm that trains a machine-learning model. In some embodiments, for example, a pipe stretch model is a machine-learning model that is trained using well data, stuck pipe data, and/or diagnostic data to predict information relating to a stuck pipe event. Training operations may use one or more training epochs in conjunction with a supervised learning algorithm. Thus, a stuck pipe manager may train a machine-learning model to generate a particular type of pipe stretch model. Likewise, a backpropagation algorithm may be used to train a machine-learning model, such as an artificial neural network. In some embodiments, a stuck pipe manager obtains a pre-trained model for use at a well site, e.g., stored in a computer system database or computer application. Likewise, a pipe stretch model may be a rule-based model that is not trained and merely uses physics-based rules to determine information relating to a stuck pipe event.

With respect to machine-learning models, different types of models may be used, such as convolutional neural networks, deep neural networks, recurrent neural networks, support vector machines, decision trees, inductive learning models, deductive learning models, unsupervised learning models, supervised learning models, reinforcement learning models, self-supervised learning models, etc. With respect to neural networks, for example, a neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights for adjusting the data inputs. These network weights may amplify or reduce the value of a particular data input, thereby assigning an amount of significance to various data inputs for a task being modeled. Through machine learning, a neural network may determine which data inputs should receive greater priority in determining one or more specified outputs of the neural network. Likewise, these weighted data inputs may be summed such that this sum is communicated through a neuron's activation function to other hidden layers within the neural network. As such, the activation function may determine whether and to what extent an output of a neuron progresses to other neurons where the output may be weighted again for use as an input to the next hidden layer.

In some embodiments, a stuck pipe manager transmits a notification (e.g., remediation procedure recommendation (370)) to one or more user devices (e.g., user device A (390)). For example, the notification may be a request for a particular user to approve or reject one or more recommended remediation procedures prior to implementation at a well system. As such, a user device may obtain a selection of a remediation procedure within a graphical user interface from a user in response to one or more user inputs. Likewise, the notification may alert various users regarding one or more conditions around the drilling rig in response to a selected remediation procedure, e.g., for safety reasons.

Keeping with FIG. 3, other types of substitute adapters may be used in a drill string or work string. A substitute adapter may be a crossover sub that may be a short subassembly that connects two components with different thread types or sizes in a well string. Another type of substitute adapter is a shock sub that may perform vibration dampening. Shock subs may be located above a drill bit to reduce stress due to bouncing when the drill bit passes through certain types of rock. Another type of substitute adapter is a bit sub, which may connect the drill bit to the lowest drill collar in a drill string. Other types of substitute adapters include kelly saver subs, sensor subs, etc. Drill collars may be heavy, stiff tubulars that have a larger outer diameter and smaller inner diameter than a drill pipe, e.g., in order to provide weight on a drill bit and rigidity.

While FIGS. 1, 2, and 3 shows various configurations of components, other configurations may be used without departing from the scope of the disclosure. For example, various components in FIGS. 1, 2, and 3 may be combined to create a single component. As another example, the functionality performed by a single component may be performed by two or more components.

Figure 4:
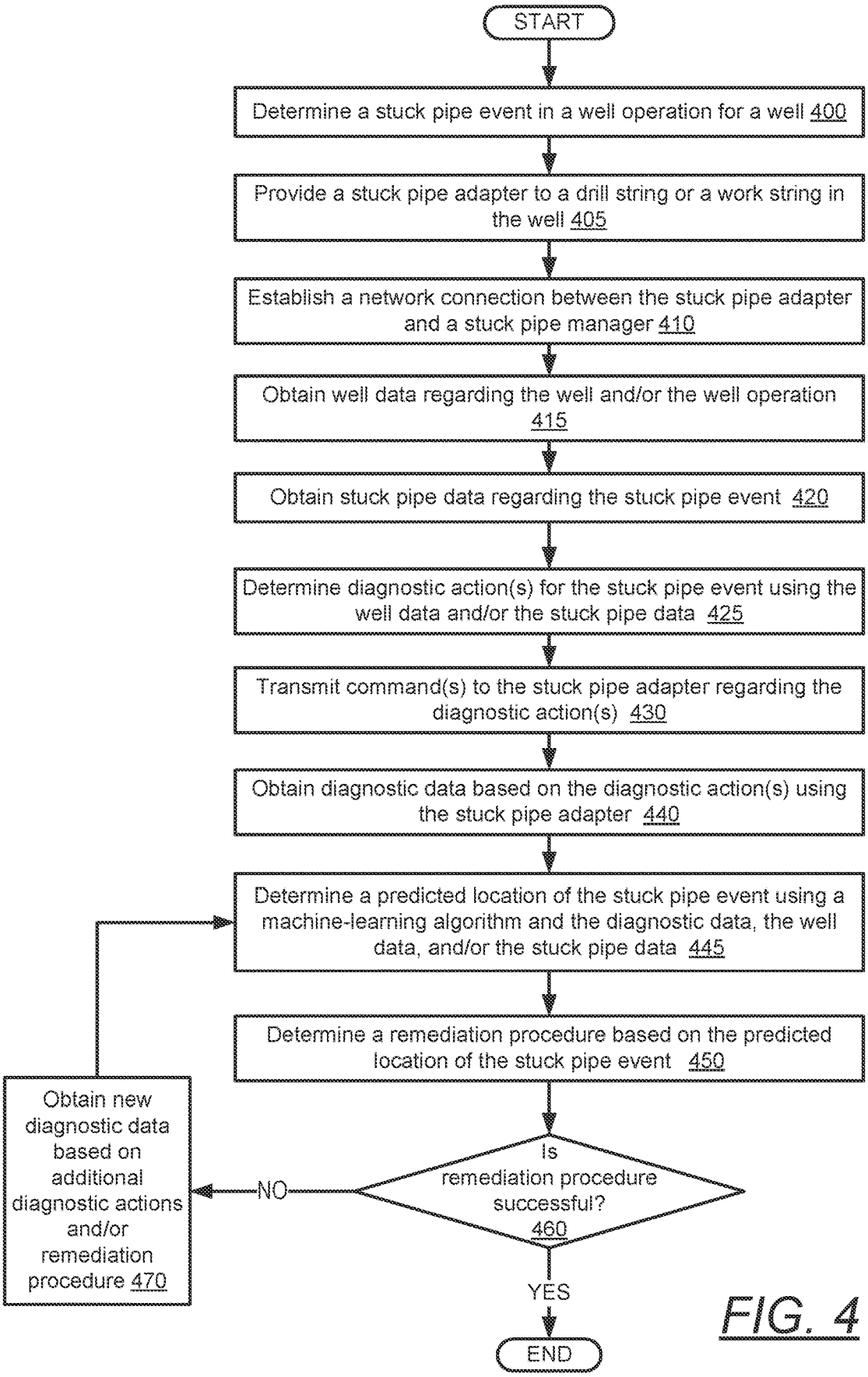
FIG. 4 shows a flowchart in accordance with one or more embodiments.

Turning to FIG. 4, FIG. 4 shows a flowchart in accordance with one or more embodiments. Specifically, FIG. 4 describes a general method for determining a predicted location of a stuck pipe event and/or a remediation procedure in accordance with one or more embodiments. One or more blocks in FIG. 4 may be performed by one or more components (e.g., stuck pipe manager Y (310)) as described in FIGS. 1, 2, and 3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, a stuck pipe event is determined in a well operation for a well in accordance with one or more embodiments. For example, a pipe section may be considered stuck if the pipe cannot be moved within a wellbore without damaging the pipe section. Likewise, a stuck pipe event may correspond to a required force that exceeds a predetermined force, e.g., a drilling rig's maximum allowed hook load. Some stuck pipe events may be detected based on changes in circulating pipe pressure, increases in torque, and/or absence of drilling fluid returning to the well surface. An increase in drag on a drill string or work string or an inability to rotate the respective string may also indicate the presence of a stuck pipe event. In some embodiments, a control system or a stuck pipe manager may analyze drilling data to determinate automatically whether a stuck pipe event has occurred. Likewise, a user at a drilling rig may use a user device to notify one or more well systems of a possible stuck pipe event.

In Block 405, a stuck pipe adapter is provided to a drill string or a work string in a well in accordance with one or more embodiments. For example, once a well network determines the presence of a stuck pipe event, an available stuck pipe adapter may be obtained from a rig floor and installed on drill pipe at the well surface. As such, a stuck pipe adapter may only be used in a drill string or work string when a possible stuck pipe event occurs. The stuck pipe adapter may be similar to the stuck pipe adapter X (320) described above in FIG. 3 and the accompanying description.

In Block 410, a network connection is established between a stuck pipe adapter and a stuck pipe manager in accordance with one or more embodiments. A stuck pipe adapter may be connected using a wire connection or a wireless connection using one or more network protocols to a stuck pipe manager and/or a control system. Thus, the stuck pipe adapter may transmit data, such as diagnostic data over the network connection.

In Block 415, well data are obtained regarding a well and/or a well operation in accordance with one or more embodiments. For example, the well data may be similar to the well data described above in FIG. 3 and the accompanying description.

In Block 420, stuck pipe data are obtained regarding a stuck pipe event in accordance with one or more embodiments. For example, stuck pipe data may be similar to the stuck pipe data described above in FIG. 3 and the accompanying description.

In Block 425, one or more diagnostic actions are determined for a stuck pipe event using well data and/or stuck pipe data in accordance with one or more embodiments. For example, a diagnostic action may alter a predetermined amount tension inside one or more pipe sections within a wellbore to produce diagnostic data regarding the stuck pipe event. Thus, a stuck pipe manager may determine different amounts of tension to analyze or verify the type of stuck pipe event as well as the location of the stuck pipe event. In some embodiments, one or more diagnostic actions are presented within a graphical user interface within a user device. Thus, a user may manage diagnostic actions for determining the location and/or type of stuck pipe event through communication with a stuck pipe manager.

In Block 430, one or more commands are transmitted to a stuck pipe adapter regarding one or more diagnostic actions in accordance with one or more embodiments. For example, a stuck pipe manager may transmit commands for different diagnostic actions based on analyzing diagnostic data in connection with well data and stuck pipe data.

In Block 440, diagnostic data are obtained based on one or more diagnostic actions using a stuck pipe adapter in accordance with one or more embodiments. For example, diagnostic data may be similar to the diagnostic data described above in FIG. 3 and the accompanying description.

In Block 445, a predicted location of a stuck pipe event is determined using a machine-learning algorithm and diagnostic data, well data, and/or stuck pipe data in accordance with one or more embodiments. In some embodiments, for example, one or more pipe stretch models are used to determine the predicted location and depth of the stuck pipe event. This information is important to know to determine if the stuck point is below a jar or above it, where a jarring process downhole may be used to free the stuck pipe. In some embodiments, related information to the stuck pipe event is determined in addition to the predicted location. For example, a stuck pipe manager may determine a depth of a free point in the wellbore where a stuck drill string may be backed off.

In Block 450, a remediation procedure is determined based on a predicted location of a stuck pipe event in accordance with one or more embodiments. In particular, a stuck pipe manager may determine one or more remediation options based on available resources at a rig. After determining a proposed remediation procedure, the stuck pipe manager may transmit a notification to a user device requesting approval for the remediation procedure. In some embodiments, the stuck pipe manager may automatically implement a selected remediation procedure by transmitting one or more commands to one or more control systems. Likewise, a stuck pipe manager may monitor the progress implementing a proposed remediation procedure. Thus, predicting the location of stuck pipe events may eliminate unnecessary remediation operations due to inaccurate assessment of stuck point locations and the type of stuck point event.

In some embodiments, a stuck pipe manager transmits one or more commands to one or more control systems at a well site to implement one or more remediation procedures. For example, if a remediation procedure includes adjusting one or more drilling fluid properties (e.g., mud weight), then a command may be transmitted to a drilling fluid property control system to cause the remediation procedure to be performed in the well. Likewise, if the remediation procedure includes a specific adjustment using the drill string, a command may be transmitted to a drilling control system, e.g., to cause a specific rotation of the drill string.

In Block 460, a determination is made whether a remediation procedure is successful in remedying a stuck pipe event in accordance with one or more embodiments. After performing a remediation procedure, a stuck pipe manager may perform another diagnostic action using a stuck pipe adapter to determine whether the stuck pipe event remains. Likewise, other operations may be performed at a well, such as operating a drill string or work string with predetermined parameters to verify whether the respective string has been freed. Where it is determined that remediation procedure has freed the stuck pipe sections, this process may end. Where it is determined that the pipe sections are still stuck, this process may proceed to Block 470.

In Block 470, new diagnostic data is obtained based on additional diagnostic actions and/or the remediation procedure in accordance with one or more embodiments. Accordingly, a stuck pipe manager may iteratively determine a predicted location of one or more stuck pipe events or a different remediation procedure based on the new diagnostic data. Likewise, a different pipe stretch model may be used to identify the location and/or type of stuck pipe event.

Figure 5:
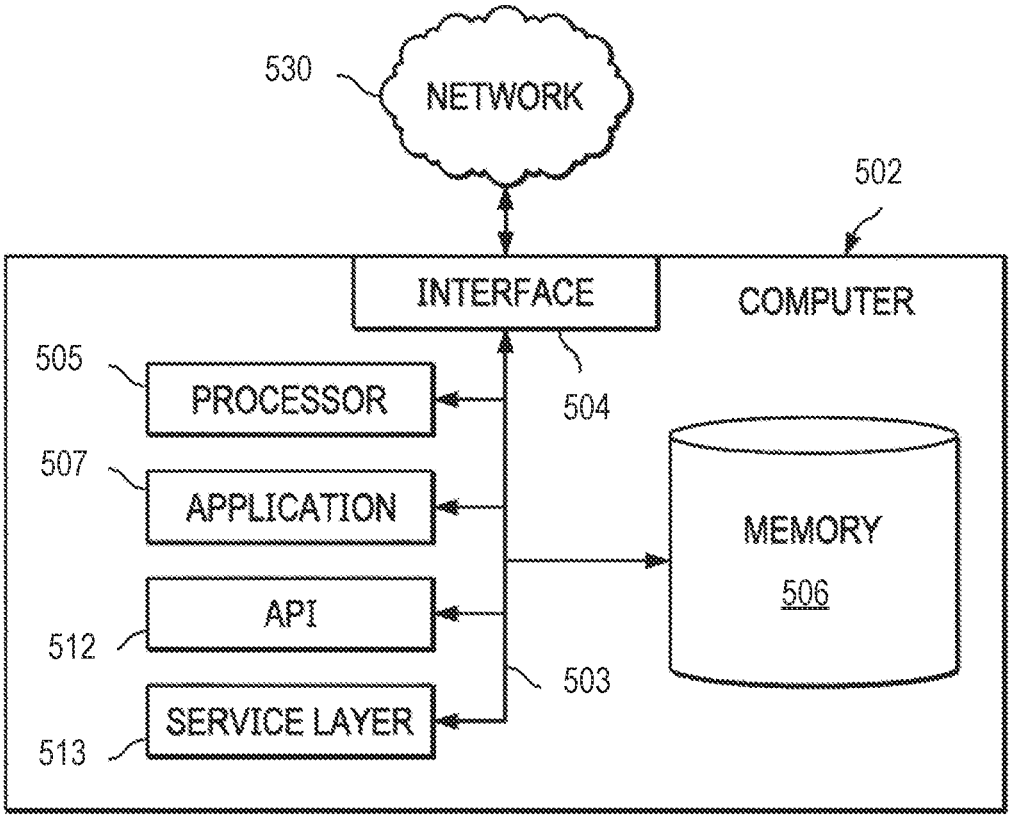
FIG. 5 shows a computer system in accordance with one or more embodiments.

Embodiments may be implemented on a computer system. FIG. 5 is a block diagram of a computer system (502) used to provide computational functionalities associated with described algorithms, methods, functions, processes, flows, and procedures as described in the instant disclosure, according to an implementation. The illustrated computer (502) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504 includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a memory (506) that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), each computer (502) communicating over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

In some embodiments, the computer (502) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

determining, by a computer processor, a stuck pipe event in a well operation for a well;

obtaining, by the computer processor, well data regarding the well operation and stuck pipe data regarding the stuck pipe event;

determining, by the computer processor and using the well data and the stuck pipe data, a diagnostic action for the stuck pipe event;

transmitting, by the computer processor, a command to a stuck pipe adapter to perform the diagnostic action, wherein the stuck pipe adapter is a substitute adapter for a drill string or a work string in the well;

obtaining, by the computer processor, diagnostic data regarding the stuck pipe event in response to the stuck pipe adapter performing the diagnostic action; and determining, by the computer processor, a predicted location in the well of the stuck pipe event based on the diagnostic data and a machine-learning algorithm.

2. The method of claim 1, further comprising:

determining, by the computer processor, a first remediation procedure for the stuck pipe event based on the predicted location.

3. The method of claim 2, wherein the first remediation procedure is selected from a group consisting of:

rotating the drill string;

adjusting a weight of a drilling fluid circulating within the well;

circulating fresh water within the well;

sending an opener into the well to drill a predetermined wall section around a predetermined pipe section; and performing a sidetracking operation around the predetermined location of the stuck pipe event.

4. The method of claim 2, further comprising:

obtaining, by the computer processor, second diagnostic data using the stuck pipe adapter in response to the first remediation operation;

determining, by the computer processor and using the second diagnostic data, whether the first remediation operation freed one or more pipe sections in the stuck pipe event; and determining, based on the second diagnostic data and in response to the first remediation operation failing to free the one or more pipe sections, a second remediation operation.

5. The method of claim 2, further comprising:

performing, by the stuck pipe adapter, the diagnostic action; and performing, by a control system, the first remediation procedure.

6. The method of claim 1, further comprising:

obtaining a pipe stretch model, wherein the pipe stretch model is an artificial neural network that is trained using second well data, second stuck pipe data, second diagnostic data for a plurality of well operations at a plurality of wells, wherein the machine-learning algorithm is a supervised learning algorithm, and wherein the prediction location of the stuck pipe event is a depth value that is output by the pipe stretch model.

7. The method of claim 1, wherein the stuck pipe adapter comprises a processor, a communication interface, and a diagnostic assembly, and wherein the diagnostic assembly generates a predetermined amount of tension on one or more pipe sections in response to the stuck pipe adapter obtaining one or more commands from a stuck pipe manager.

8. The method of claim 1, wherein the stuck pipe event is selected from a group consisting of:

a predetermined pipe cannot be removed from a wellbore without exceeding a predetermined hook load for a drilling rig;

a drill string becomes embedded in a mud cake;

an inability to rotate a drill string;

a stationary cuttings bed forms on a side of the well; and a keyseating section forms on a side of the well.

9. An apparatus, comprising:

a computer processor;

a communication interface;

a plurality of sensors;

a diagnostic assembly coupled to the plurality of sensors and the computer processor, wherein the diagnostic assembly is configured to apply a predetermined amount of tension in a drill string or a work string, wherein the diagnostic assembly comprises an electric motor and a lead screw, and wherein the command is transmitted by a stuck pipe manager; and a memory coupled to the computer processor, wherein the memory comprises functionality for:

obtaining, over a network connection, a command to perform a diagnostic action to the drill string or the work string, generating, using the plurality of sensors and the diagnostic assembly, diagnostic data based on performing the diagnostic action, and transmitting, over the network connection, the diagnostic data.

10. The apparatus of claim 9, further comprising:

a pipe connector configured to couple to a pipe section in the drill string or the work string.

11. The apparatus of claim 9, further comprising:

a connector configured to couple to a substitute adapter in the drill string or the work string, wherein the substitute adapter is configured to couple to a pipe section in the drill string or work string.

12. The apparatus of claim 9, wherein the network connection is a wireless connection, and wherein the command is transmitted by a stuck pipe manager.

13. A system, comprising:

a drilling rig;

a drill string coupled to the drilling rig, the drill string comprising a plurality of pipe sections;

a stuck pipe adapter coupled to the drill string, the stuck pipe adapter comprises a first computer processor and a communication interface, wherein the stuck pipe adapter is configured to produce a predetermined amount of tension in at least one pipe section among the plurality of pipe sections; and a stuck pipe manager coupled to the stuck pipe adapter, the stuck pipe manager comprising a second computer processor, wherein the stuck pipe manager comprises functionality for:

obtaining well data regarding a drilling operation and stuck pipe data regarding a stuck pipe event associated with the drill string;

determining, using the well data and the stuck pipe data, a diagnostic action for the stuck pipe event;

transmitting a command to the stuck pipe adapter that causes the stuck pipe adapter to perform the diagnostic action;

obtaining diagnostic data regarding the stuck pipe event in response to the stuck pipe adapter performing the diagnostic action; and determining a predicted location in the well of the stuck pipe event based on the diagnostic data and a machine-learning algorithm.

14. The system of claim 13, further comprising:

a control system coupled to the stuck pipe manager, the control system being configured to manage one or more drilling fluid properties regarding a drilling fluid circulating in the well, wherein the stuck pipe manager further comprises functionality for:

determining a remediation action for the stuck pipe event based on the predicted location, and transmitting a command to the control system to perform the remediation procedure, and wherein the remediation procedure is an adjustment of a weight of a drilling fluid circulating within the well.

15. The system of claim 13, further comprising:

a control system coupled to the stuck pipe manager, the control system being configured to manage a drilling operation in the well, wherein the stuck pipe manager further comprises functionality for:

determining a remediation action for the stuck pipe event based on the predicted location, and transmitting a command to the control system to perform the remediation procedure, and wherein the remediation procedure is a rotation of the drill string.

16. The system of claim 13, wherein the stuck pipe manager further comprises functionality for:

obtaining a pipe stretch model, wherein the pipe stretch model is an artificial neural network that is trained using second well data, second stuck pipe data, second diagnostic data for a plurality of well operations at a plurality of wells, wherein the machine-learning algorithm is a supervised learning algorithm, and wherein the prediction location of the stuck pipe event is a depth value that is output by the pipe stretch model.

17. The system of claim 13, further comprising:

a user device coupled to the stuck pipe manager, wherein the user device presents, using a graphical user interface, a recommendation for a plurality of remediation procedures in response to the diagnostic action, wherein the user device obtains, in response to a user input within the graphical user interface, a user selection of a remediation procedure among the plurality of remediation procedures, and wherein the stuck pipe manager is configured to transmit a command that triggers the remediation procedure in response to the user selection.

18. The system of claim 13, wherein the stuck pipe adapter comprises a processor, a communication interface, and a diagnostic assembly, and wherein the diagnostic assembly generates a predetermined amount of tension on one or more pipe sections in response to the stuck pipe adapter obtaining one or more commands from a stuck pipe manager.

19. The system of claim 13, wherein the stuck pipe event is selected from a group consisting of:

a predetermined pipe cannot be removed from a wellbore without exceeding a predetermined hook load for a drilling rig;

a drill string becomes embedded in a mud cake;

an inability to rotate a drill string;

a stationary cuttings bed forms on a side of the well; and a keyseating section forms on a side of the well.

* * * * *